US005730477A

United States Patent [19]

Nagy

[11] Patent Number: 5,730,477

[45] Date of Patent: Mar. 24, 1998

[54] CONNECTING-ROD GUIDE BRACKET FOR WINDOWS, DOORS, OR THE LIKE

[75] Inventor: Siegfried Nagy, Velbert, Germany

[73] Assignee: Carl Fuhr & Co., Heiligenhaus, Germany

[21] Appl. No.: 455,695

[22] Filed: May 31, 1995

[51] Int. Cl.[6] ..... E05C 1/00

[52] U.S. Cl. ..... 292/32; 292/DIG. 20; 292/DIG. 47

[58] Field of Search ..... 24/543, 559; 292/DIG. 47, 292/DIG. 20, 32, 35

[56] References Cited

U.S. PATENT DOCUMENTS

| | | | |
|---|---|---|---|
| 3,906,592 | 9/1975 | Sakasegawa et al. | 24/73 |
| 3,949,525 | 4/1976 | Bates et al. | 49/395 |
| 4,193,174 | 3/1980 | Stephens | 24/543 |
| 4,378,617 | 4/1983 | Burns | 24/543 |
| 4,536,924 | 8/1985 | Willoughby | 24/543 |
| 4,610,472 | 9/1986 | Billingsley | 292/DIG. 47 |
| 4,640,575 | 2/1987 | Dumas | 292/1 |
| 4,705,308 | 11/1987 | Bisbing | 292/109 |
| 4,775,121 | 10/1988 | Carty | 24/543 |
| 4,803,808 | 2/1989 | Greisner | 292/DIG. 20 |
| 4,897,900 | 2/1990 | Baggett | 24/543 |
| 5,087,087 | 2/1992 | Vetter et al. | 292/DIG. 47 |
| 5,263,671 | 11/1993 | Baum | 24/543 |
| 5,313,721 | 5/1994 | Filden | 24/543 |
| 5,423,831 | 6/1995 | Nates | 24/543 |

FOREIGN PATENT DOCUMENTS

| | | |
|---|---|---|
| 2906723 | 2/1979 | Germany . |
| 3134162 | 6/1982 | Germany . |

*Primary Examiner*—Rodney M. Lindsey
*Attorney, Agent, or Firm*—Martin A. Farber

[57] ABSTRACT

A connecting-rod guide bracket for windows, doors or the like, having parallel guide plates (14, 15) spaced apart from each other, between which there is a spacer member (17) for passage through a slot (18) in the connecting rod (12), at least one of the two guide plates (14, 15) forming a stop surface (26) which can be fixed by fastening means. In order to produce in simple manner the compound engagement between connecting-rod guide bracket and connecting rod, a plug-type connection is provided between the two guide plates (14, 15).

13 Claims, 5 Drawing Sheets

18
21
14
22'
23'
23
13
16
21
31
28
12
20
19
26
22
17
1
15
19
20
1'

1
18
19,20
14
13
15
17
19,20
16
31
28
VI
VI
1'
25
23
12
28'

CONNECTING-ROD GUIDE BRACKET FOR WINDOWS, DOORS, OR THE LIKE

FIELD AND BACKGROUND OF THE INVENTION

The present invention relates to a connecting-rod guide bracket for windows, doors, or the like which has parallel guide plates spaced apart from each other, between which there is a spacer member for passage through a slot in the connecting rod, at least one of the two guide plates forming a stop surface which can be fixed in position by fastening means.

A connecting-rod guide bracket of the type in question is known from Federal Republic of Germany 31 34 162 A1, in which the connecting-rod guide bracket, developed with an H-shaped cross section, rests in an undercut groove in the frame of a window casement. By fastening means which are developed as turnbuckles, the stop surface of the connecting-rod guide bracket is clamped against inward-directed ribs of the groove in the frame. In order that, in one development of the connecting-rod guide bracket, the one guide plate can pass through the slot in the connecting rod, said one guide plate must be bendable in such a manner that it can be brought to the width of the slot. This requires the pressure in the guide plate of a recess which extends in the longitudinal direction of the direction of displacement of the connecting rod, which of course weakens the guide plate.

SUMMARY OF THE INVENTION

The object of the invention is to develop the connecting-rod guide bracket of the type in question, in such a manner while simple to manufacture, that, with a stable construction, an easier bringing about of a composite engagement between connecting-rod guide bracket and connecting rod is present.

This object is achieved with a connecting-rod guide bracket of the type in question by means of an interlocking connection between the two guide plates.

As a result of this development, a connecting-rod guide bracket of this type is obtained which is of stable construction and the form-locking of which to the connecting rod can be brought about more easily. The guide plates are fed from both sides in the region of the connecting-rod slot. The interlocking connection between the two guide plates then secures their position with respect to each other. If the connecting-rod guide bracket is then held fast on the window side by means of the fastening means, the guide plates cannot leave their proper position with respect to the connecting rod. The connecting-rod guide bracket can be of stable development so that a long useful life is also assured.

Advantages in guidance result in this connection by connecting elements which are arranged in the space between the guide plates and the width of which corresponds to the width of the spacer member. Thus, the spacer member, on the one hand, and the connecting elements, on the other hand, serve for the guidance of the connecting rod.

It should furthermore be emphasized that the connecting elements are developed as detent tongues which protrude from one guide plate and engage behind mating detent means on the other guide plate. An irreversible attachment can be produced in this way so that after the bringing into action of the detent tongues, the guide plates are locked in parallel position to each other.

It has been found optimal to provide two detent parts arranged facing each other in the direct vicinity of the edge of the guide plates which are of essentially square contour. Thus, on the one hand, the one guide plate bears the detent tongues and, on the other hand, the other guide plate bears the mating detent parts, namely in the edge region of the guide plates of substantially square contour, so that their length in the direction of displacement of the connecting rod serves as guide length.

From the standpoint of connection technique, it is favorable for the two guide plates to be connected to each other spaced apart by a hinge tab. In that way, assurance is had that the correct guide plates can always be associated with the connecting rod in parallel position.

Economical manufacture of the connecting-rod guide bracket is obtained in the manner that the guide plates consist of plastic and the hinge is developed as a film hinge. In this way, the connecting-rod guide bracket can be developed as a single structural part on which the film hinge as well as the detent means and the spacer member are developed.

From a manufacturing standpoint, it is advantageous in this connection for the film hinge to be formed on the one mating detent means, and accordingly to represent a bridge between the two guide plates.

Assembly is facilitated by an adjustment nose which protrudes laterally from the spacer member and can be sheared-off upon the first actuation. This nose cooperates with a lateral niche in the slot in the connecting rod.

In order to secure the two guide plates in locked position, a screw passage opening is provided passing through the two guide plates and the spacer member. The fastening means, developed as a screw, is passed through said opening upon the fastening of the connecting-rod guide bracket.

In the case of a connecting-rod fitting having at least one guide bracket in connection with which the connecting rod is guided spaced from a resting surface and has locking members for cooperation with corresponding mating closing parts, advantages with regard to locking technique result from the fact that the distance between the the mating closure parts is greater than the distance between the locking members. In this way, the locking members pass continuously, one after the other, into locking position with respect to the mating holding parts associated with them.

The closing action of the window casement is favored by the fact that the locking members are of drop shape in cross section. In this way, wedge surfaces are produced which facilitate the pulling of the window casement into the closed position.

Further advantages in guidance result from the fact that the locking members have a support pin which passes through the connecting rod and extends over the intervening free space directly up to the application surface for the connecting-rod guide bracket. This support pin assures parallel guidance of the connecting rod with respect to the application surface for the connecting-rod guide bracket.

Finally, the fact that the one guide plate rests on the mating detent means associated on the edge side with the other guide plate has a stabilizing effect. In this way, the one guide plate is imparted additional support in its parallel position to the other guide plate.

BRIEF DESCRIPTION OF THE DRAWINGS

With the above and other objects and other advantages in view, the present invention will become more clearly understood in connection with the detailed description of a preferred embodiment, when considered with the accompanying drawings of which.

DETAILED DESCRIPTION OF THE PREFERRED EMBODIMENT

Figure 1:
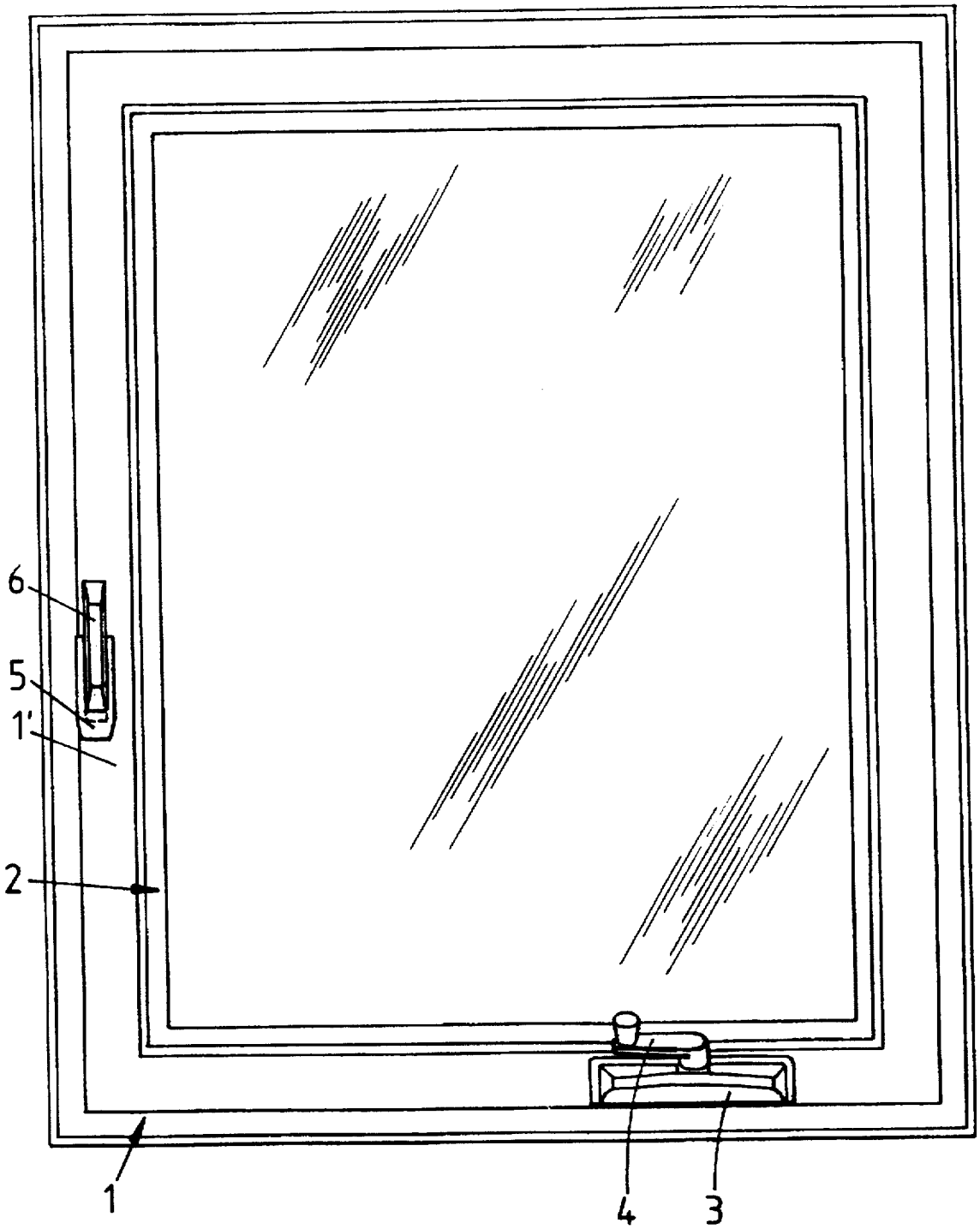
FIG. 1 is an outside view of a window provided with the connecting-rod guide bracket of the invention, shown in its closed position.

The window shown in FIG. 1 has a fixed frame 1 and a window casement 2 which swings around a vertical axis arranged on the right. Plastic hollow shapes are used both for the fixed frame 1 and for the window casement 2. The corresponding seals are known and have not been shown in the drawing.

A gear 3 affixed on the inside of the fixed frame 1 serves for the opening and closing of the window casement 2. This gear can be actuated by a crank 4 which can be placed on it, the displacement of the window casement 2 around the vertical axis taking place via a rod not shown in the drawing. Before a turning of the crank 4 can be effected in order, for instance, to open the window casement 2, an actuating handle 5 mounted on the left-side vertical arm 1' of the fixed frame must be swung upward by 180°. The actuating handle 5 is mounted on the pivot pin 7 borne by a bearing bracket 6. The swinging of the actuating handle 5 leads to the carrying along of a link strap 8 which, in its turn, moves a slide 9 in a perpendicular direction. Into its fork slot 10 there engages a driving projection 11 which, in its turn, extends from a connecting rod 12. The latter is arranged in the groove between fixed frame 1 and window casement 2 and is guided in vertical direction on the fixed frame 1.

Figure 2:
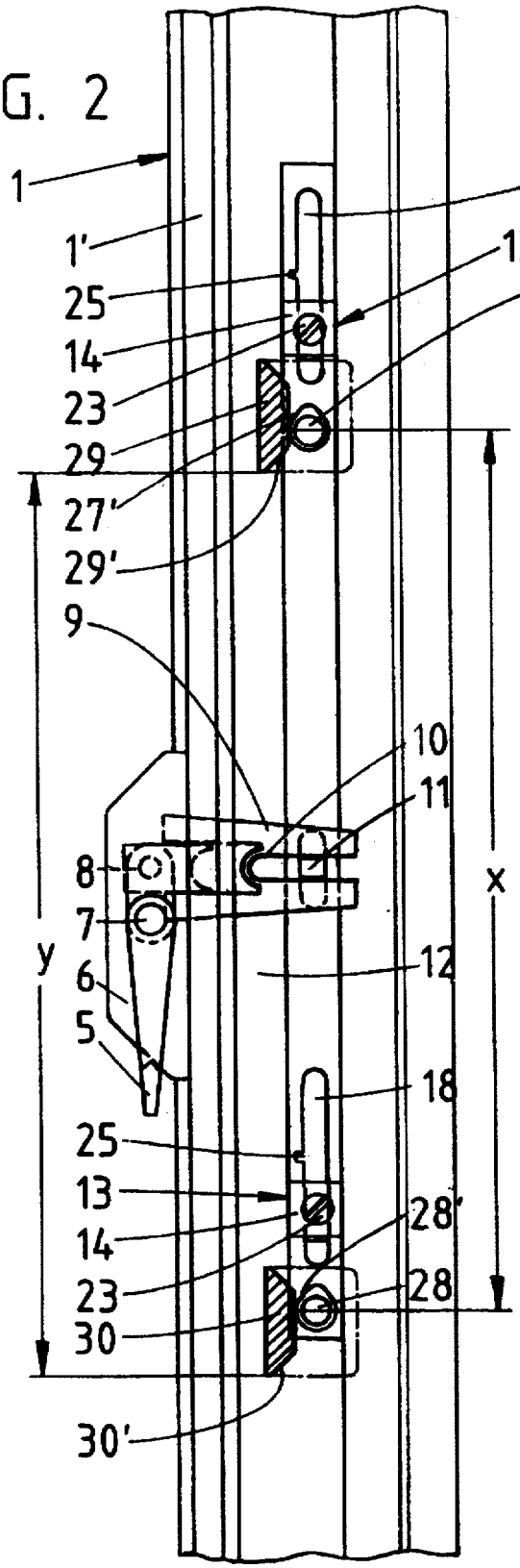
FIG. 2 is an inner view of the fixed-frame arm arranged on the left in FIG. 1, with which the connecting rod is associated, with the connecting rod in the locked position and mating closure parts shown in cross section.
Figure 3:
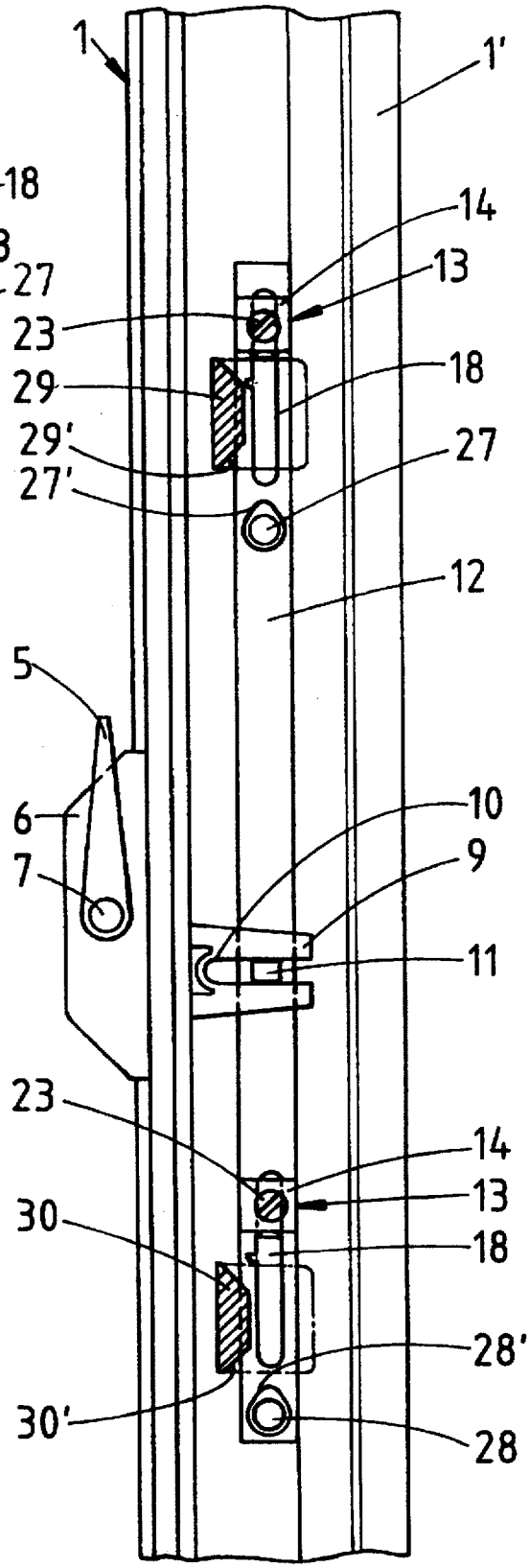
FIG. 3 is a view corresponding to FIG. 2 in which, differing from the latter, the actuating handle is turned 180°, bringing the connecting rod into the unlocked position.
Figure 4:
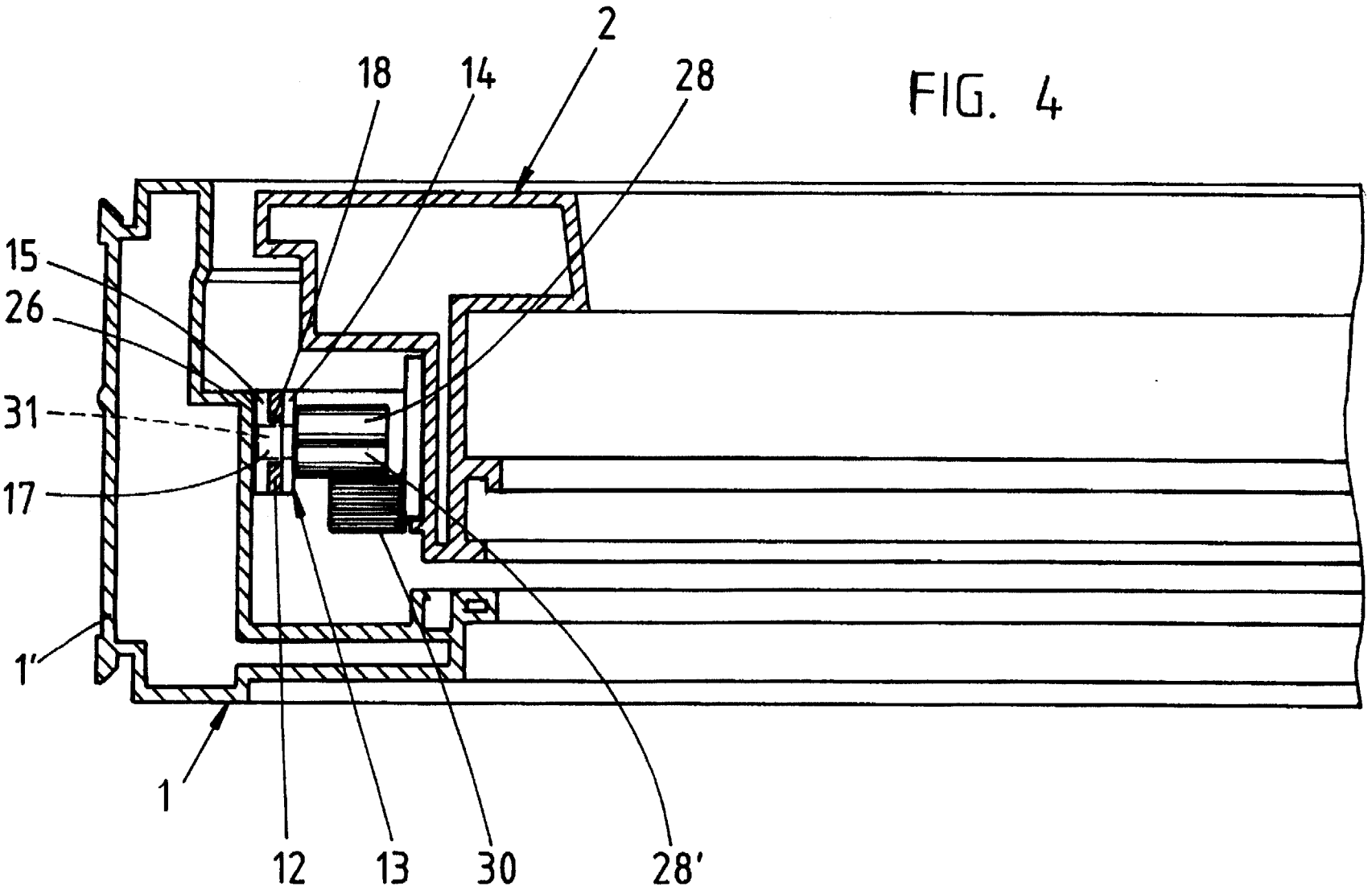
FIG. 4 is a partial horizontal section through the window in the region above a guide bracket.

Two connecting-rod guide brackets 13 fastened on the fixed frame 1 serve for the guiding of the connecting rod 12 which extends on both sides of the bearing bracket 6. One connecting-rod guide bracket 13 each guides an end section of the connecting rod 12; see FIGS. 2 and 3.

The connecting-rod guide brackets 13 are identical to each other. Each connecting-rod guide bracket 13 has two guide plates 14, 15, of square contour. The two guide plates 14, 15 are connected together, spaced apart, by a hinge tab 16. The guide plates 14, 15 consist of plastic, and the hinge place or hinge tab 16 is developed as a film hinge around which the two guide plates 14, 15 can be swung with respect to each other. A spacer member 17 of square contour is developed in the middle region of the one guide plate 14. The side length of the spacer member 17 is slightly less than the width of the slot 18 in the connecting rod 12. The height of the spacer member 17 is somewhat greater than the thickness of the connecting rod 12. The two guide plates 14, 15 can be swung around the film hinge 16 and brought into an interlocking connection with each other. For this purpose there serve connecting elements which are arranged in the space between the guide plates 14, 15 and the width of which corresponds to that of the spacer member 17. These connecting elements are developed as two detent tongues 19 extending from the one guide plate 14 and engaging behind two mating detent parts 20 on the other guide plate 15.

The connecting elements 19, 20 arranged opposite each other in the immediate vicinity of the edges of the respective guide plates 14,15, and lie in a row with the spacer member 17. The widths of the connecting elements 19, 20 corresponds furthermore to that of the spacer member 17, so that guidance of the connecting rod 12 over the length of the connecting-rod guide bracket 12 is provided.

Figures 5, 6:
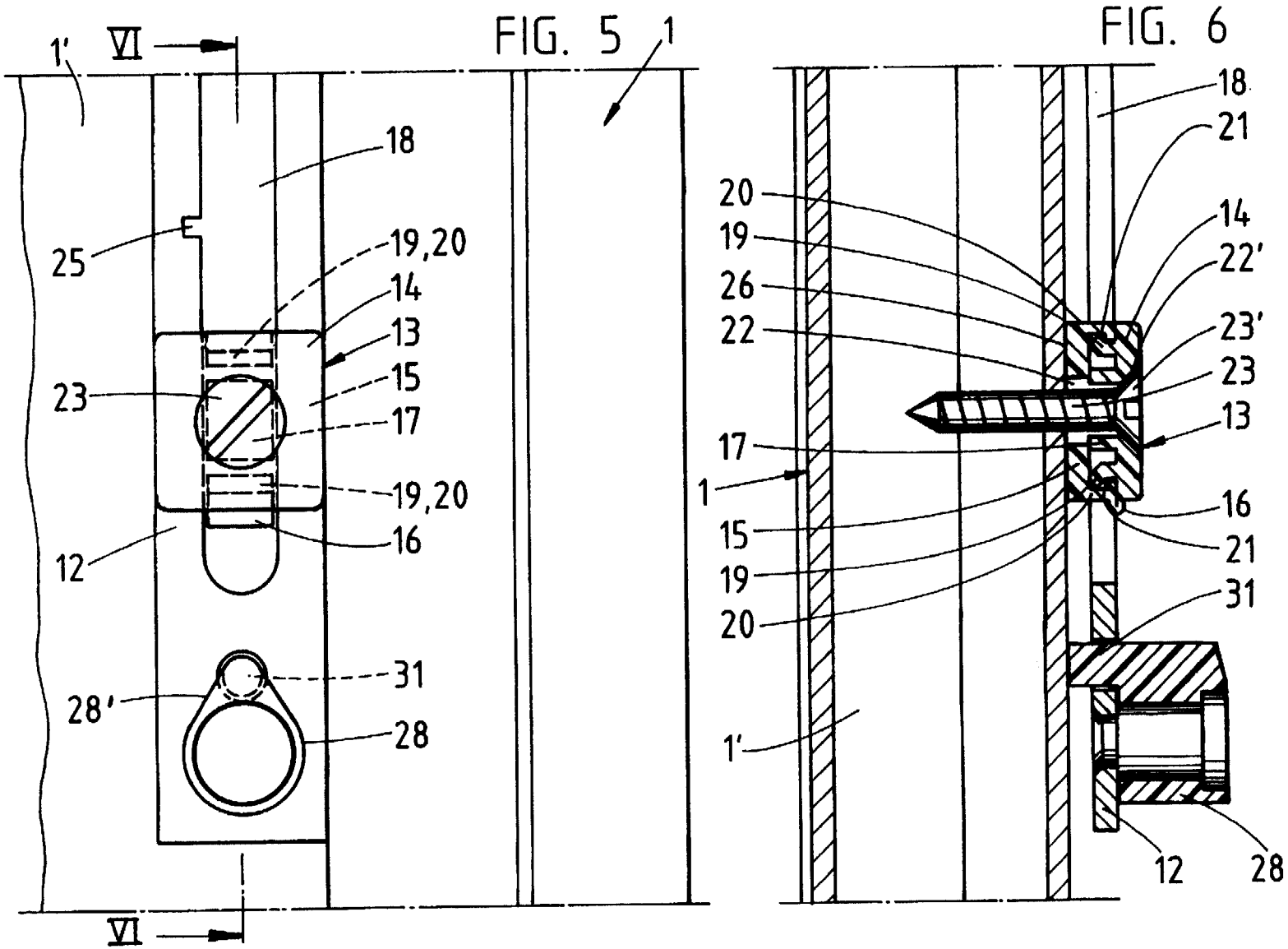
FIG. 5 is an enlargement of a detail of FIG. 2.
FIG. 6 is a cross section along the line VI—VI of FIG. 5.
Figure 7:
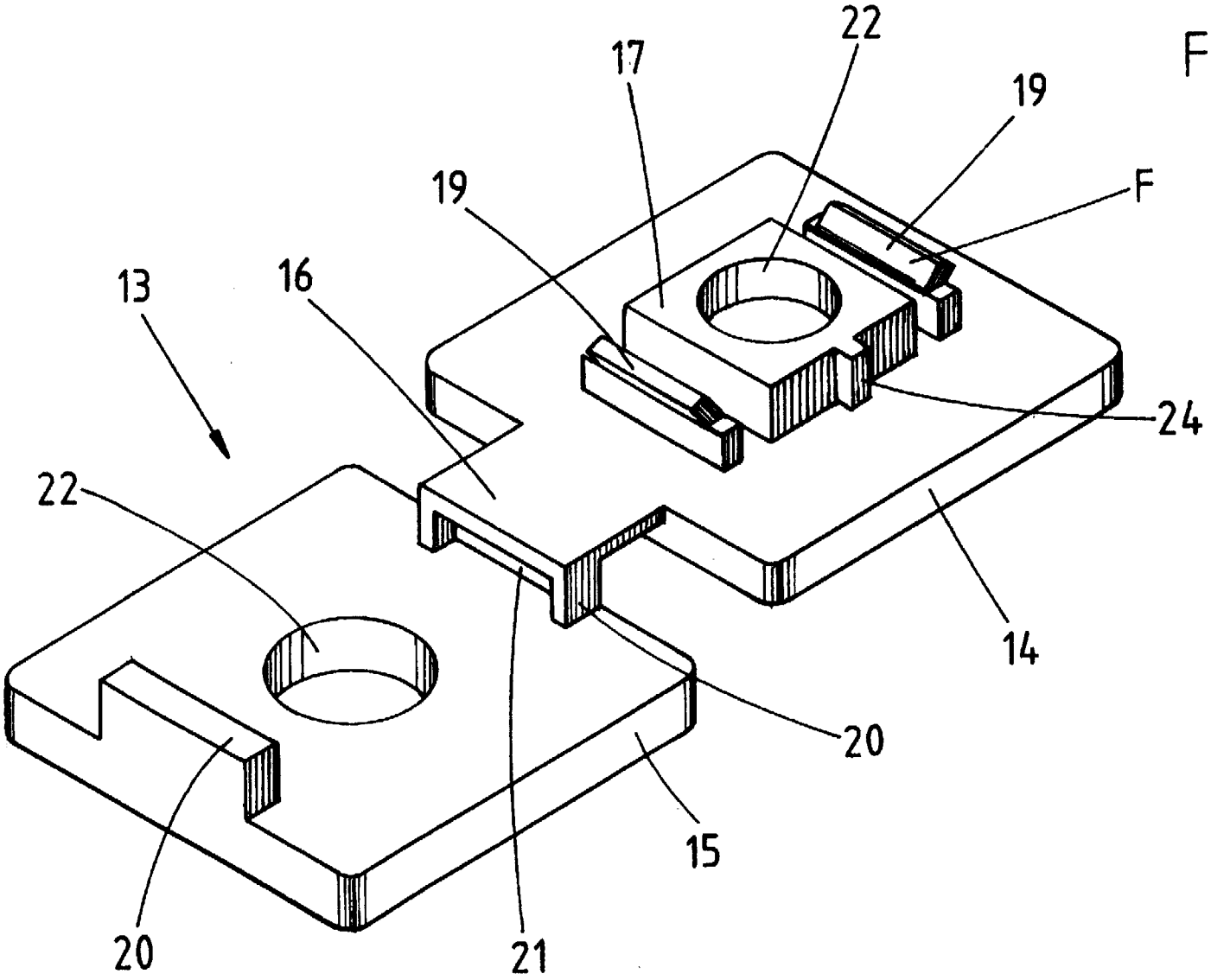
FIG. 7 is a perspective view of the guide plates connected by a film hinge prior to the engagement.

As can be noted, in particular, from FIG. 7, the film hinge 16 is developed on one of the detent parts 20. The mating detent parts 20 are so shaped that they develop detent openings 21, the width of each being is less than that of the respective detent part. The end regions of the detent tongues 19 are adapted to the widths of the detent openings 21. The detent tongues 19 have run-on bevels F which lead to a moving apart of the detent tongues 19 when the guide plates are swung against each other so that they then extend in detent fashion into the detent openings 21 and fix the parallel position of the guide plates 14, 15. In the position of the guide plates 14, 15 swung against each other, the one guide plate 14 lies on the mating detent part 20 associated with the other guide plate 15 on the edge side, obtaining additional support; see, in particular, FIG. 6.

For the fastening of the connecting-rod guide bracket 13 on the fixed frame 1, there is provided a screw passage opening 22 passing through the two guide plates 14, 15 and the spacer member 17, for the passage of a fastening screw 23 which engages into the material of the fixed frame. Said screw is provided with a flat head 23'. In order that it terminate flush with the outer surface of the guide plate 14, the guide plate has a countersunk hole 22' in the extension of the screw passage opening.

The connecting-rod guide brackets 13 are brought in combination with the connecting rod 12 in the manner that in each case the guide plates 14, 15 of each connecting-rod guide bracket 13 are swung around the film hinge in such a manner that the spacer member 17 and the detent connecting elements 19, 20 pass through the slot 18.

In the mounted position, an adjustment nose 24 which protrudes on the side of the spacer member 17 engages in form-locked manner into a slot-side niche 25 of the connecting rod 12. The actuating handle 5 then assumes a middle position between the two end positions. If, starting herefrom, the actuating handle 5 is swung in one or the other direction, the adjustment nose 24 is sheared off.

The stop surface 26 for the connecting-rod guide bracket 13 is formed by the side of the guide plate 15 facing away from the mating detent part 20.

The connecting rod 12 is the bearer of two locking members 27, 28 which, in the embodiment shown, are arranged in each case below the guide bracket 13. They cooperate with mating closure parts 29, 30 on the window casement side. These closure parts are equipped with run-on bevels 29', 30' which cooperate with locking members 27, 28 of drop-shape cross section. In this way, obliquely rising wedge surfaces 27', 28' result on the locking members 27, 28, they cooperating with the run-on bevels 29', 30'.

The distance y between the mating closure parts 29, 30 is, in this connection, greater than the distance x between the locking members 27, 28, so that, upon a locking of the window casement by swinging the actuating handle 5 through 180°, first the locking member 28 and then the locking member 27 come into the closed position with regard to the associated mating closure part 30, 29.

Each locking member 27, 28 is provided with a support pin 31 which passes through the connecting rod 12 and, with the connecting-rod guide bracket 13 attached, extends directly up to the application surface for the connecting-rod guide bracket. In this way, the connecting rod 12 receives support in the direction of this application surface.

I claim:

1. A guide bracket for a connecting rod, wherein the rod is operative with a casement including a window casement and a door casement, the casement being supported within a frame, the connecting rod having a slot, the bracket comprising:

two parallel guide plates lying spaced from each other, a hinge tab for passage through said slot and connecting the two guide plates to each other, and a spacer member disposed between said plates for passage through said slot in the connecting rod, said spacer member permitting translation of said connecting rod between said guide plates, said spacer member extending from one of said plates to a second of said plates for establishing a distance between said two plates; and wherein at least one of the two guide plates has a stop surface for secure abutment with said frame, said spacer member has means passing through the spacer member for receiving a fastening element, and a connection device for passage through said slot for an interlocking connection between the two guide plates.

2. A connecting-rod guide bracket according to claim 1, wherein said connection device comprises a plurality of connecting elements arranged in a space between the guide plates, each of the connecting elements having a width which corresponds to a width of said spacer member.

3. A connecting-rod guide bracket according to claim 2, wherein said connecting elements comprise detent tongues which extend from one of said guide plates, and detent parts which extend from a second of said guide plates to mate with said detent tongues.

4. A connecting-rod guide bracket according to claim 3, wherein individual ones of said detent tongues are arranged opposite corresponding ones of said detent parts in the direct vicinity of edges of said guide plates, each of said guide plates being substantially square in contour.

5. A connecting-rod guide bracket according to claim 3, wherein said one of said guide plates rests on said detent parts of said second of said guide plates, each of said detent parts being on an edge of said second guide plate.

6. A connecting-rod guide bracket according to claim 1, wherein each of said guide plates comprises plastic, and said hinge tab is a film hinge.

7. A connecting-rod guide bracket according to claim 6, further comprising:

a plurality of connecting elements arranged in a space between the guide plates;

wherein said connecting elements comprise detent tongues which extend from one of said guide plates, and detent parts which extend from a second of said guide plates to mate with said detent tongues; and said film hinge is developed on one of said detent parts.

8. A connecting-rod guide bracket according to claim 1, wherein said means for receiving a fastening element comprises a screw passage opening in each of said two guide plates and in said spacer member.

9. A connecting-rod guide bracket according to claim 1, wherein said bracket has a cross-sectional H-shaped structure at the location of the spacer member.

10. A guide bracket for a connecting rod, wherein the rod is operative with a casement including a window casement and a door casement, the casement being supported within a frame, the connecting rod having a slot, the bracket comprising:

two parallel guide plates lying spaced from each other, and a spacer member disposed between said plates for passage through said slot in the connecting rod, said spacer member permitting translation of said connecting rod between said guide plates, said spacer member extending from one of said plates to a second of said plates for establishing a distance between said two plates;

wherein at least one of the two guide plates has a stop surface for secure abutment with said frame, there being a interlocking connection between the two guide plates; and the guide bracket further comprises an adjustment nose which protrudes outwardly from a side of said spacer member to engage with an element of said slot, said nose being adapted to be sheared off by said element upon a first actuation of the connecting rod.

11. An assembly of a connecting rod and a fitting for the connecting rod, wherein the rod is operative with a casement including a window casement and a door casement, the casement being supported within a frame, the frame having a plurality of closure parts, the connecting rod having a slot, the fitting serving to guide the rod within the frame, the fitting comprising a plurality of brackets for being supported within said frame;

wherein each of said guide brackets comprises two parallel guide plates lying spaced from each other, and a spacer member disposed between said plates for passage through said slot in the connecting rod, each of said plates extending beyond said rod in a direction transverse to a longitudinal direction of said rod for engagement with said rod, said spacer member permitting translation of said connecting rod between said guide plates, and at least one of the two guide plates having a stop surface for secure abutment with said frame, there being an interlocking connection between the two guide plates;

said brackets permit a guidance of said connecting rod spaced apart from an application surface;

said fitting has a plurality of locking members connecting with said rod to cooperate with said closure parts in a locking operation; and a distance between two of the closure parts is greater than a distance between a corresponding two of the locking members.

12. An assembly according to claim 11, wherein each of said locking members has a drop-shape cross section.

13. An assembly according to claim 11, wherein each of said locking members is located in a respective one of said brackets, and has a support pin which passes through said connecting rod and extends over an intervening free space directly up to said application surface.

* * * * *